US007395795B2

(12) United States Patent
Osakabe et al.

(10) Patent No.: US 7,395,795 B2
(45) **Date of Patent: *Jul. 8, 2008**

(54) OUTBOARD MOTOR

(75) Inventors: Takayuki Osakabe, Shizuoka (JP); Yoshibumi Iwata, Shizuoka (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/647,632

(22) Filed: Dec. 29, 2006

(65) Prior Publication Data

US 2007/0240665 A1 Oct. 18, 2007

(30) Foreign Application Priority Data

Apr. 18, 2006 (JP) ..... 2006-114735

(51) Int. Cl.
*F02M 35/10* (2006.01)

(52) U.S. Cl. ..... 123/184.55; 123/184.36; 123/184.49; 440/88 A

(58) Field of Classification Search ..... 123/184.35, 123/184.36, 184.43, 184.44, 184.48, 184.49, 123/184.53, 184.54, 184.55; 440/88 A
See application file for complete search history.

(56) References Cited

U.S. PATENT DOCUMENTS

| | | | | |
|---|---|---|---|---|
| 6,736,100 | B2 | 5/2004 | Katayama | |
| 7,213,558 | B2 * | 5/2007 | Iwata et al. | 123/184.55 |
| 2006/0102128 | A1 | 5/2006 | Iwata et al. | |

FOREIGN PATENT DOCUMENTS

| | | |
|---|---|---|
| JP | A-2002-195118 | 1/2002 |

* cited by examiner

*Primary Examiner*—Noah Kamen
(74) *Attorney, Agent, or Firm*—Knobbe Martens Olson & Bear LLP

(57) ABSTRACT

An outboard motor is mounted on a hull and has an engine disposed in an upright position in a cowling so that a crankshaft thereof extends generally vertically during cruising. An embodiment of the motor includes a first surge tank disposed on the opposite side of a cylinder head of the engine with respect to the crankshaft of the engine; long intake pipes that communicate with the first surge tank and an intake port of the engine; second surge tanks disposed between the long intake pipes and the engine for communicating with the first surge tank; short intake pipes provided in the midway of the long intake pipes on the engine side for communicating with the second surge tanks; and on-off valves for opening and closing the short intake pipes.

14 Claims, 6 Drawing Sheets

[FIG. 1]
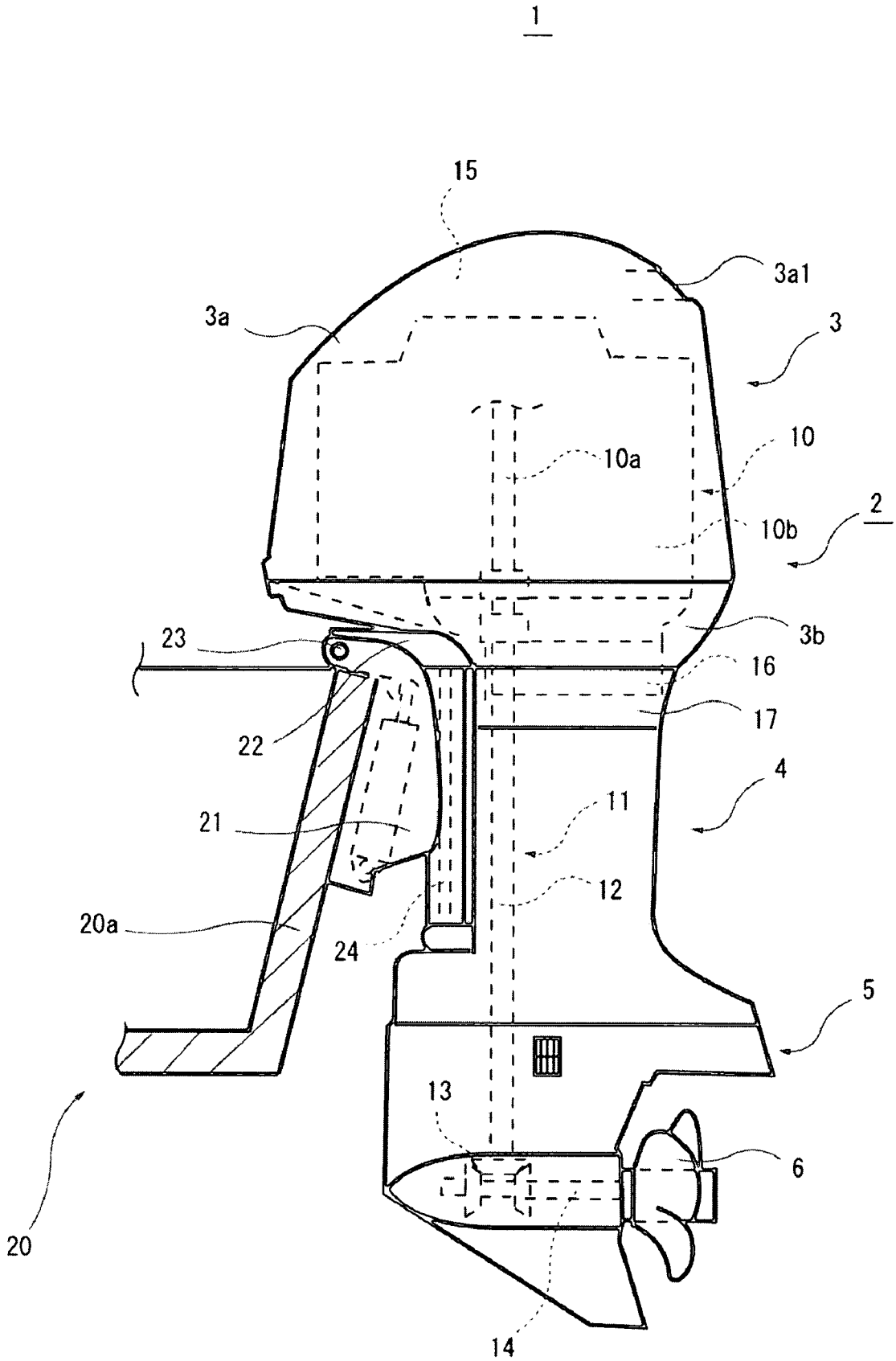

[FIG. 2]
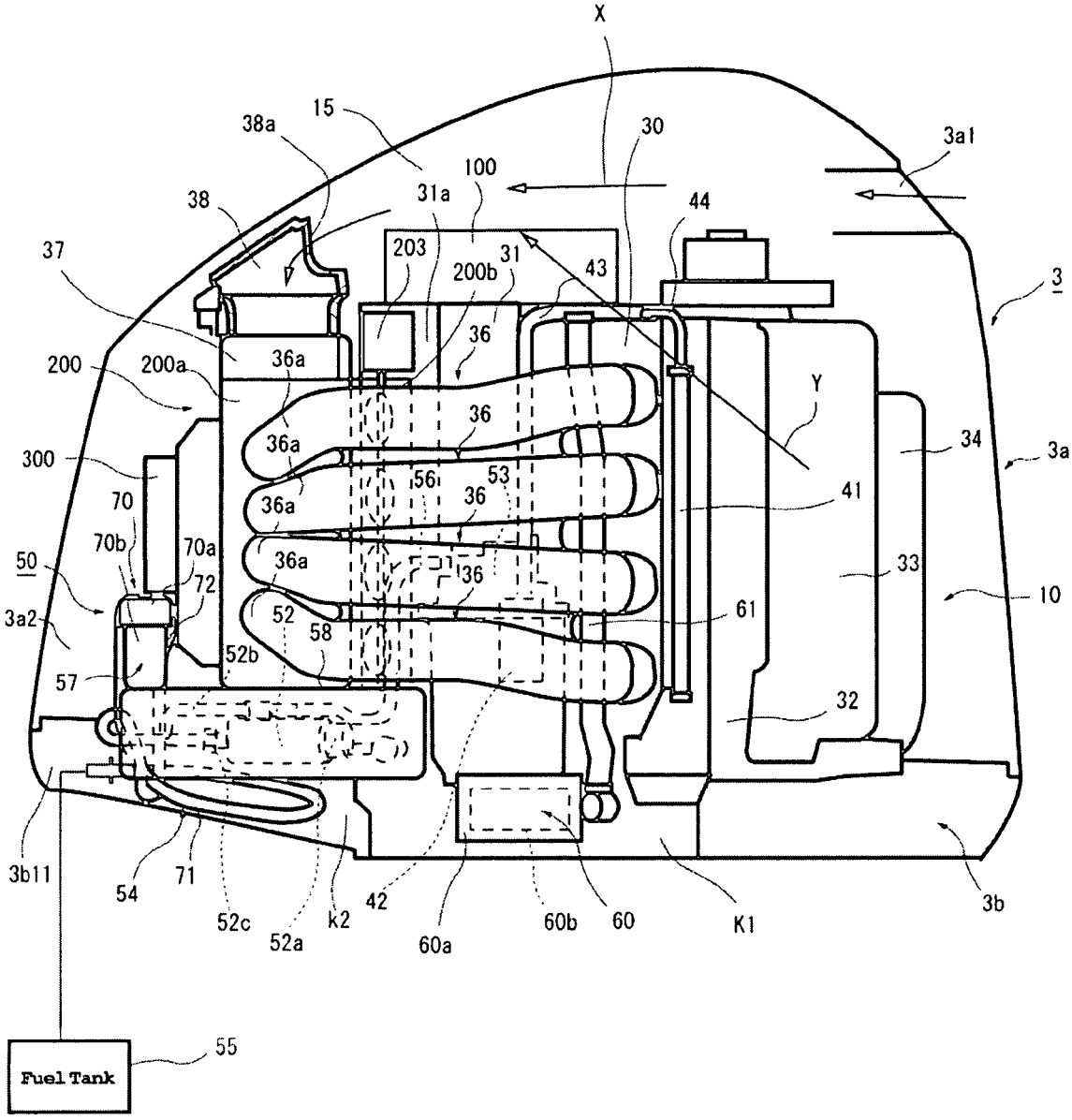

[FIG. 3]
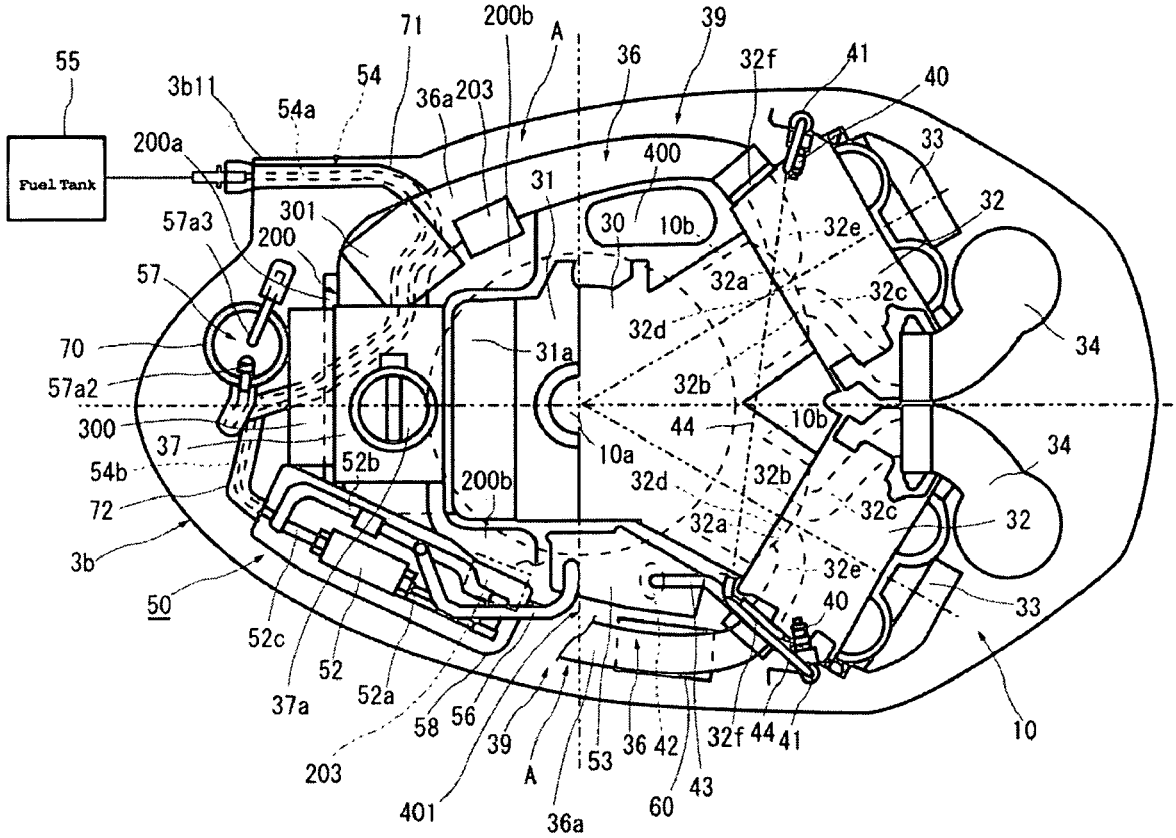

[FIG. 4]
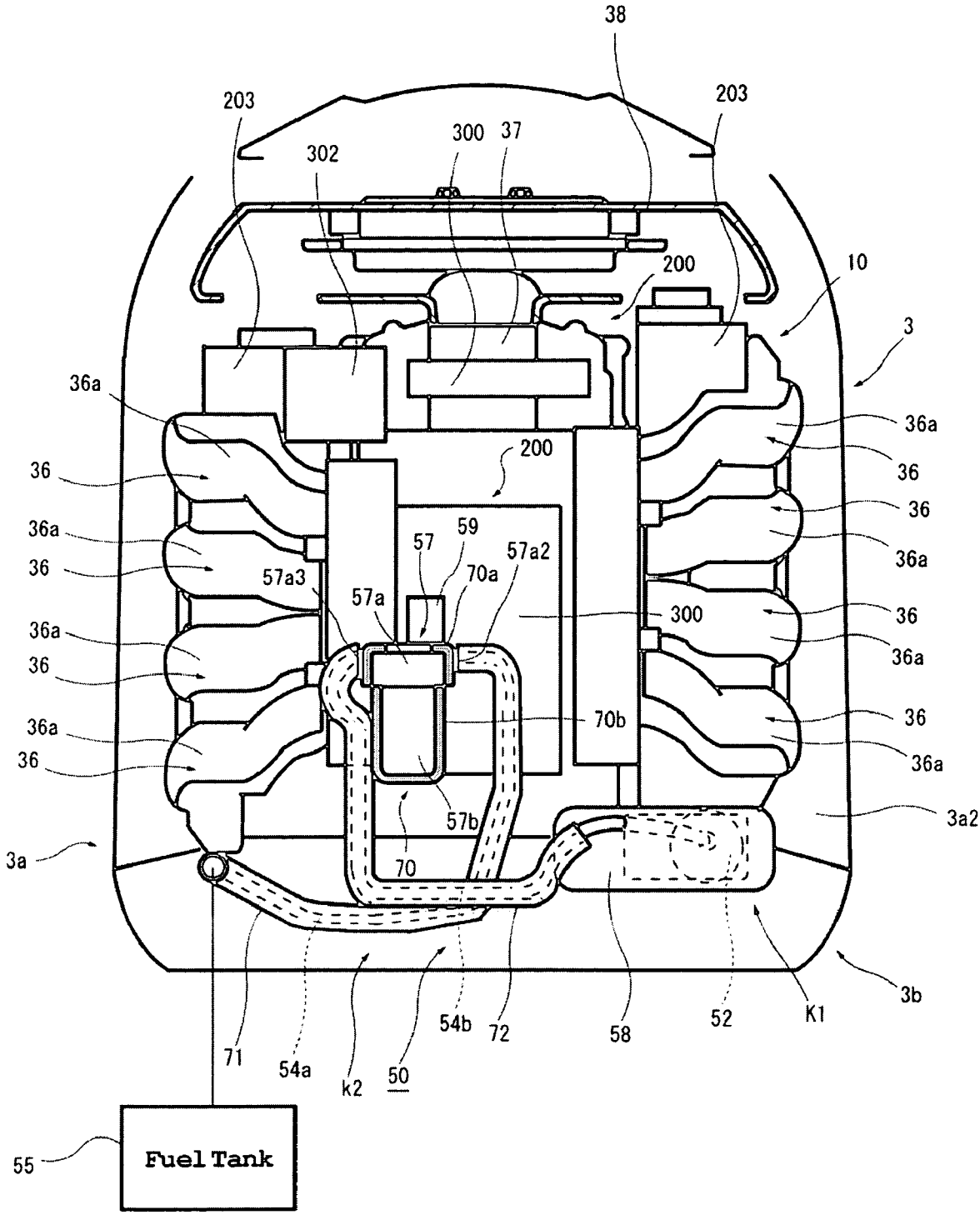

[FIG. 5]
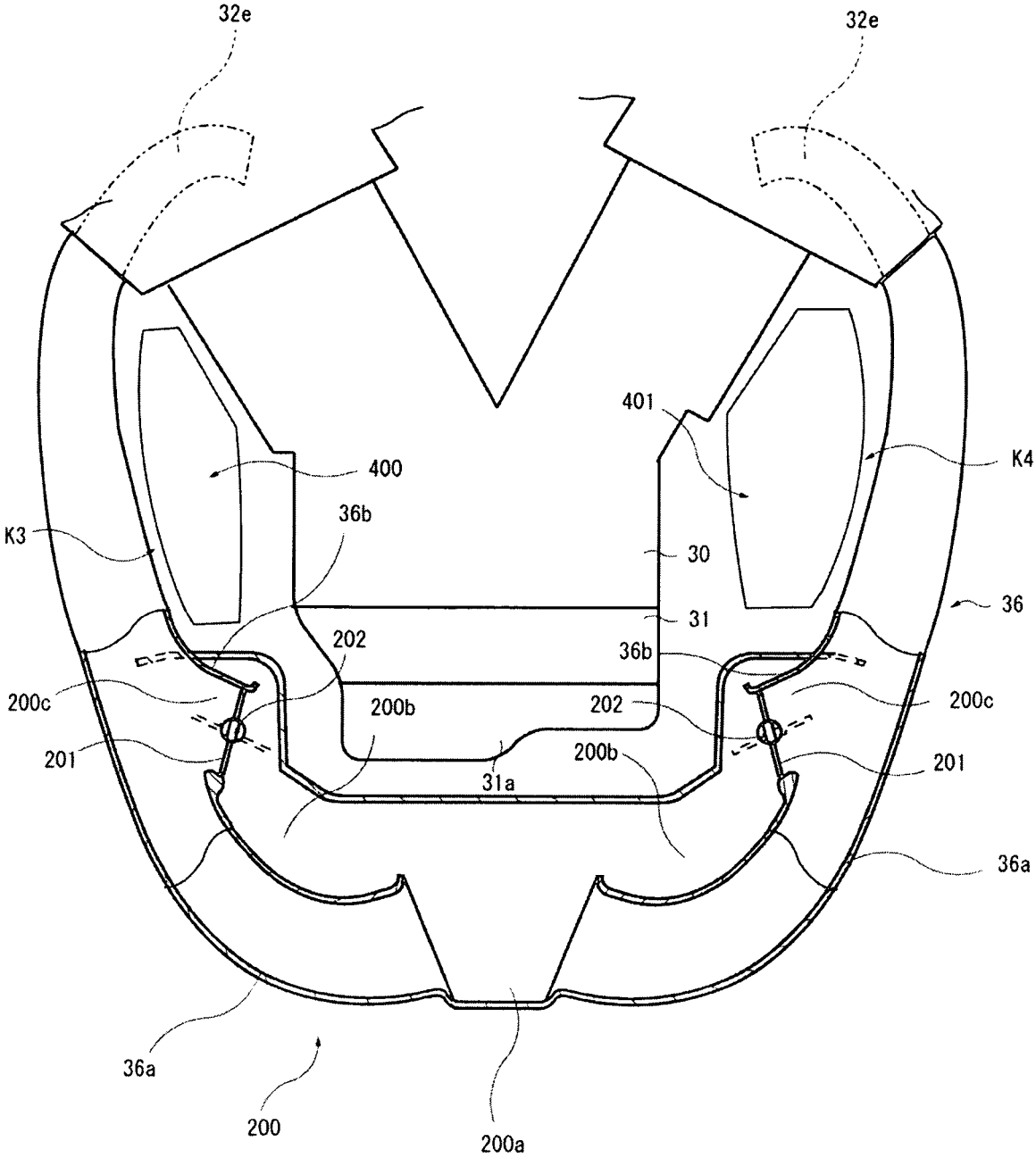

[FIG. 6]
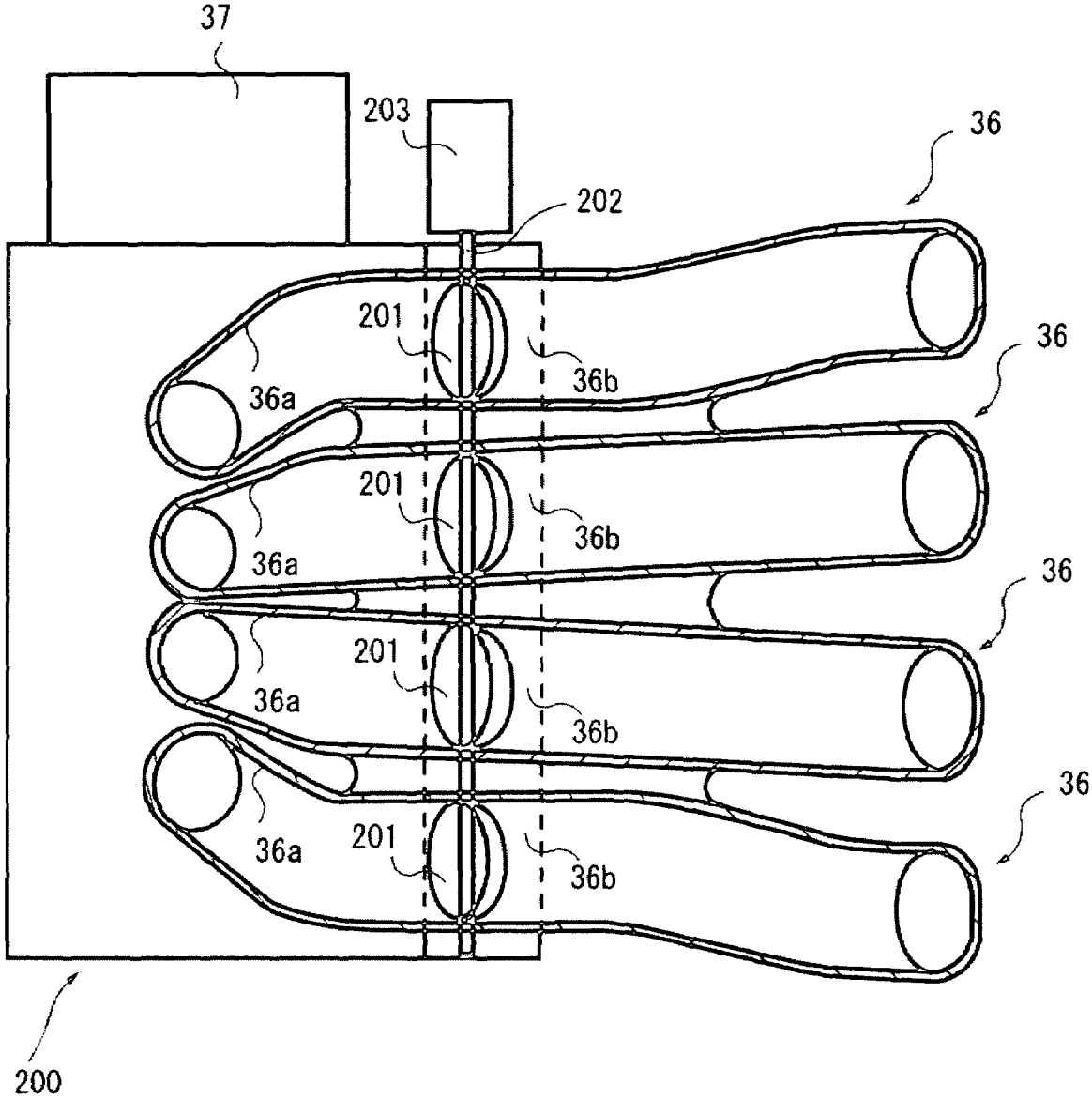

OUTBOARD MOTOR

CROSS-REFERENCE TO RELATED APPLICATIONS

This application is based on and claims priority to Japanese Patent Application Serial No.2006-114735, which was filed on Apr. 18, 2006, the entirety of which is hereby incorporated by reference.

BACKGROUND OF THE INVENTION

1. Field of the Invention

The present invention relates to an outboard motor equipped with an engine having a variable intake pipe length.

2. Description of the Related Art

Outboard motors are typically mounted on a hull of a watercraft and include an engine disposed within a cowling of the motor such that a crankshaft of the engine extends generally vertically when the watercraft is cruising. For some engines, an effective length of each engine air intake conduit can be varied in accordance with an engine speed so as to, for example, obtain the inertia charge effect of air intake.

For example, in prior art document No. JP-A-2002-195118, the intake pipe for drawing the air in low and mid speed ranges is located on the engine side of the surge tank, and such intake pipe has to be bent to conserve space within the motor cowling. Excessive bending of the intake pipe results in the increased resistance of the intake air. Thus, the intake pipe is only moderately bent, resulting in a configuration in which the intake pipe is somewhat spaced from the engine. Consequently, more space is occupied by the intake pipe, resulting in an increase in the overall dimensions of the outboard motor.

SUMMARY OF THE INVENTION

Accordingly, there is a need in the art for a simple structure and method that can optimize engine performance of a V-type engine by changing effective lengths of right and left side intake conduits.

The present invention is made in view of the concerns described above, and an object of one embodiment is to provide an outboard motor having a variable effective intake pipe length that employs a simple structure that doesn't increase the overall dimensions of the outboard motor.

In accordance with an embodiment, the present invention provides an outboard motor adapted to be mounted on a hull of a watercraft. The outboard motor includes an engine generally enclosed within a cowling and having a crankshaft arranged to extend generally vertically when an attached watercraft hull is in a cruising condition. The outboard motor further comprises a first surge tank disposed on a side of the crankshaft generally opposite a head portion of the engine, a plurality of long intake conduits having first and second ends and extending between an engine intake port and the surge tank, and a second surge tank disposed between the plurality of long intake conduits and the engine. The second surge tank communicates with the first surge tank. A plurality of short intake conduits is also provided. Each of the short intake conduits is provided between the first and second ends of a corresponding one of the long intake conduits and communicates with the second surge tank. Valves are provided for selectively opening and closing the short intake conduits.

In another embodiment, the engine comprises a left and a right bank of cylinders arranged in a V-type configuration. In one such embodiment, second surge tanks are provided on opposing sides of the engine, and the second surge tanks communicate with one another. In another such embodiment, spaces are defined between at least a portion of the long intake conduit and the engine on either side of the engine, and an auxiliary component is disposed in each space.

In yet another embodiment, a plurality of valves are arranged to have coaxial valve shafts, and an actuator for selectively opening and closing the valves is arranged coaxially with the valve shafts. In one such embodiment, the actuator is disposed in a space defined between the engine and an outer surface of a long intake conduit.

In accordance with another embodiment, a space is defined between at least a portion of the long intake conduit and the engine, and an auxiliary component is disposed in the space. In one such embodiment, the auxiliary component comprises a starter motor.

BRIEF DESCRIPTION OF THE DRAWINGS

FIG. 1 is a side view of an outboard motor.

FIG. 2 is a side view illustrating the configuration of an engine of the outboard motor.

FIG. 3 is a plan view illustrating the configuration of the engine of the outboard motor.

FIG. 4 is a front view illustrating the configuration of the engine of the outboard motor.

FIG. 5 is a transverse cross-sectional view illustrating an intake structure.

FIG. 6 is a vertical cross-sectional view illustrating the intake structure.

DETAILED DESCRIPTION OF PREFERRED EMBODIMENTS

Description is hereinafter made of embodiments of an outboard motor according to the present invention. The embodiments discussed herein are preferred modes for carrying out the invention, and the present invention is not limited thereto. In a preferred embodiment, the front side of the outboard motor is defined as a hull side, the rear side of the outboard motor indicates the side opposite the hull side, and a direction perpendicular to a horizontal direction is defined as a vertical direction.

With initial reference to FIG. 1, an outboard motor 1 has a propulsion unit 2 having a housing portion consisting of a cowling 3, an upper case 4 and a lower case 5. An engine 10 is housed in the cowling 3 on the upper side with its crankshaft 10*a* extending vertically, and a propeller 6 that is rotatably driven by the engine 10 is attached to the lower case 5 on the lower side. The engine 10 is disposed with the crankshaft 10*a* on the hull side and cylinders 10*b* on the opposite side from the hull side. A power transmission mechanism 11 and an exhaust passage (not shown) extending from the engine 10, and other components preferably are housed in the upper case 4 and lower case 5, and the propeller 6 is rotatably driven by the engine 10 via the power transmission mechanism 11. The illustrated power transmission mechanism 11 includes a drive shaft 12, a shift switching mechanism 13, a propeller shaft 14, and related components.

In the illustrated embodiment, the cowling 3 forms an engine room 15, and is made up of a top cowling 3*a* and a bottom cowling 3*b*. Air is introduced into the engine room 15 through an air intake port 3*a*1 for the engine 10 formed through a rear part of the top cowling 3*a*. An exhaust guide 16 is disposed at the upper end of the upper case 4, and the engine 10 is secured to the top surface of the exhaust guide 16.

The bottom cowling 3*b* is secured to an upper periphery of the exhaust guide 16 with bolts, and the upper end of the upper case 4 is secured to a lower periphery of the exhaust guide 16 with bolts. An apron 17 preferably is attached to surround an upper part of the upper case 4 and the exhaust guide 16. The top cowling 3*a* covering the engine 10 from above is openably attached from above to the bottom cowling 3*b* and removably joined to the bottom cowling 3*b*.

The outboard motor 1 is attached to the rear end of the hull 20. The hull 20 has a transom plate 20*a* to which a clamp bracket 21 is secured. A swivel bracket 22 is rotatably pivoted to the clamp bracket 21 by a tilt shaft 23, and the propulsion unit 2 is pivoted to the swivel bracket 22 for rotation about a steering shaft 24.

With reference next to FIG. 2 to FIG. 6, the illustrated engine 10 is a four-cycle V-type eight-cylinder engine having a left and a right cylinder bank. The outboard motor 1 is mounted on the transom plate 20*a* for swinging movement between a cruising state in which the crankshaft 10*a* extends generally vertically and a retracted position in which the crankshaft 10*a* extends generally horizontally. A crankcase 31 is joined to the front mating face of the cylinder block 30 of the engine 10, and a crankcase cover 31*a* is joined to the crankcase 31. Cylinder heads 32 are joined to the rear mating faces of the cylinder block 30, and each of the cylinder heads 32 has a cam chamber side opening covered with a head cover 33. In the cruising state, the head covers 33 and the cylinder heads 32 of the engine 10 face backward in the longitudinal direction of the hull. A flywheel 100 connected to the crankshaft 10*a* is disposed on the engine 10.

In the cylinder block 30, right and left cylinders 10*b* are formed with their axes forming a V-bank and extending toward the crankshaft 10*a*. In each cylinder head 32, intake valve openings 32*a* and exhaust valve openings 32*b* are formed for each cylinder, and each of the intake valve openings 32*a* and the exhaust valve openings 32*b* is communicated with its corresponding combustion chamber 32*d* in the V-bank.

Each of the exhaust valve openings 32*b* is communicated with its corresponding one of exhaust manifolds 34 through its corresponding exhaust port 32*c* extending to the V-bank, and exhaust gas is discharged into the water below the engine through exhaust manifolds 34.

Each of the intake valve openings 32*a* opens in a side wall of its corresponding cylinder head 32 through its corresponding intake port 32*e*, and each of the intake ports 32*e* has an external connecting opening 32*f* which is connected to its corresponding one of intake manifolds 36. The intake ports 32*e* and the intake manifolds 36 form curved portions 39 extending forward toward the hull from the intake valve openings 32*a* in a generally arcuate form, and the curved portions 39 are connected to a surge tank 200 to form intake passages A extending forward. A throttle body 37 including a throttle valve 37*a* is connected to the surge tank 200, and an intake silencer 38 is connected to the upstream side of the throttle body 37. The intake silencer 38, which is located in front of the engine 10, is of a size extending almost across the entire width of the cowling 3 and has an intake opening 38*a* through which air is introduced.

The illustrated embodiments of the surge tank 200 and the intake manifolds 36 are described in detail based on FIG. 5 and FIG. 6. The surge tank 200 preferably consists of a first surge tank 200*a* and two second surge tanks 200*b*, and has a vertically elongated shape that cooperates with the intake manifolds 36. Each of the intake manifolds 36 is connected to the surge tank 200 and has long intake conduits, or pipes 36*a* and short intake conduits, or pipes 36*b* that both open into the surge tank 200.

The first surge tank 200*a* is located on the opposite side of the cylinder head 32 of the engine 10 with respect to the crankshaft 10*a* of the engine 10. In the illustrated embodiment, the first surge tank 200*a* is located in front, that is, on the hull side, of the engine 10, and the first surge tank 200*a* communicates with each of the long intake pipes 36*a*. Each of the long intake pipes 36*a* also communicates with the intake port 32*e* of its corresponding cylinder 10*b*. The intake ports 32*e* preferably are formed on the outside of the cylinder rows of the V-type engine 10. The two second surge tanks 200*b* are communicated with the first surge tank 200*a* and disposed between the long intake pipes 36*a* and the engine 10. The two second surge tanks 200*b* on both sides of the engine 10 preferably communicate with each other to ensure a larger capacity.

It is to be understood that the surge tank 200 can have various structures. For example, in the illustrated embodiment, the surge tanks 200*a* 200*b* are all co-formed as one overall surge tank 200. In another embodiment, separately formed surge tanks 200*a*, 200*b* can be formed. Preferably, the surge tanks 200*a*, 200*b* communicate with one another to form a single effective surge tank 200 whether the individual tank portions 200*a*, 200*b* are formed separately or co-formed.

In the illustrated V-type engine having the left and right cylinder banks, the long intake pipes 36*a* are located outside the cylinder bank. In such arrangement, a dead space is defined by the cylinder banks, the crankcase 31, and the long intake pipes 36*a*. The two second surge tanks 200*b* extend from the crankcase cover 31 a to a midportion of the crankcase 31, thus providing substantial capacity for the second surge tank 200*b* without increasing the size of the outboard motor 1.

Each of the short intake pipes 36*b* extends into its corresponding second surge tank 200*b*, and is disposed on the inside, that is, the engine side, of an intermediate portion of its corresponding long intake pipe 36*a*, and has an opening 200*c* communicated with the second surge tank 200*b*. Each of the second surge tanks 200*b* is disposed between the long intake pipes 36*a* and the engine. Each of the short intake pipes 36*b* preferably is provided with an on-off valve 201 for opening and closing the short intake pipe 36*b* at its opening 200*c* to the long intake pipe 36*a*.

In the illustrated embodiment, the on-off valves 201 are attached to a corresponding valve shaft 202 that extend generally vertically parallel to the crankshaft 10*a*. An actuator 203 is disposed at the upper end of each of the valve shafts 202. The valve shafts 202 are rotated by the actuators 203 to open and close the openings 200*c* with the on-off valves 201. Since the actuators 203 are located coaxially with the valve shafts 202 for the on-off valves 201, the number of parts can be small and the manufacturing cost can be reduced. Also, since the actuators 203 can be directly connected to the valve shafts 202, the reliability of operation can be improved. In the illustrated embodiment, the on-off valves 201 are the butterfly-type and are connected to their corresponding valve shafts 202. Driving motors used as the actuators 203 at the upper ends of the valve shafts 202 are preferably negative pressure diaphragms, DC motors, stepping motors or the like. Other types of motors can also be employed. In an additional embodiment valves can be individually controlled and actuated, or may be actuated in groups of one, two, three or more.

Although the actuators 203 are located immediately above the on-off valves 201 in the embodiment illustrated in FIGS. 2-6, they may be located immediately below the on-off valves 201 and coaxially with the valve shafts. When the actuators 203 are located immediately above the on-off valves 201 as described above, the actuators 203 can be disposed in a dead space surrounded by the uppermost intake manifold 36, the flywheel 100, and the top cowling 3*a*. When the actuators 203 are located immediately below the on-off valves 201, the actuators 203 can be disposed in a dead space between the lowermost intake manifold 36 and the bottom cowling 3*b*. In either case, the actuators 203 can be installed without increasing the external dimensions of the cowling 3.

With reference again to FIGS. 2-4, the engine 9 preferably is provided with an electric component 300 such as a controller and an electric auxiliary component 301 including a relay and a fuse. The electrical components 300 are located within the cowling 3, and preferably are fixed to the center and upper part on the front wall of the surge tank 200. The detected values from various types of sensors including an engine speed sensor, a watercraft speed sensor, a throttle position sensor, an intake pressure sensor, an O2 sensor, and other sensors (not shown) are input to the electrical components 300 which in turn control the fuel injection timing and duration, as well as the ignition timing, based on various operation control maps incorporated in the electrical components 300. The electrical components 300 preferably also control the actuators 203 to open and close the openings 200*c* by means of the on-off valves 201. The electric auxiliary component 301 including a relay and a fuse is attached to an upper right portion of the front wall of the surge tank 200.

By controlling the actuators 203 to open or close the openings 200*c* with the on-off valves 201, the intake pipe length can be selected between a relatively long length suitable for low- and intermediate-speed operation and a relatively short length suitable for high-speed operation. For example, opening the on-off valves 201 in the high-speed operation range effectively shortens the intake conduit length, and closing the on-off valves 201 in the low-and intermediate-speed operation range effectively lengthens the intake conduit length. In other words, an intake pipe length suitable for the operating condition of the engine 10 can be obtained. Therefore, an inertia charging effect can be achieved and target torque characteristics can be obtained in all the operating ranges of the engine 10.

Since the second surge tanks 200*b* are disposed along the engine side of the long intake pipes 36*a* and the intake pipes 36*a* extend along the outer portion of the surge tanks 200 as described above, the curvature of the long intake pipes 36*a* can be minimum. In addition, the first surge tank 200*a* disposed on the hull side of the engine 10 can be shaped with fewer restrictions in comparison with the intake manifold 36. Thus, the surge tank 200 can be provided taking full advantage of the gap between the long intake pipes 36*a* and the engine 10, filling-in the vacancy around the engine. This enables creation of substantial surge tank 200 volume without adding to the overall dimensions of the outboard motor 1.

The on-off valves 201 to open and close the short intake pipes 36*b* preferably are also positioned on the inner side of the long intake tubes 36*a*, that is, on the side closer to the engine. Consequently, the actuator 203 for driving the on-off valves 201 can be positioned closer to the engine when viewed from the top, relative to the position on the outer side of the long intake pipes 36*a*. Such arrangement avoids adding to the dimension of the outboard motor 1 that may result from the actuator 203 protruding sideways. In this way, the effective length of the intake pipe can be altered by a simple structure that does not increase the overall dimensions of the outboard motor 1.

As shown in FIG. 5. dead spaces K3 and K4 as viewed from the top are defined between the cylinder block 30 of the engine 10 and the long intake pipes 36*a* on the left and the right, respectively. Larger electrical components 400, such as a starter motor, preferably are disposed in the dead space K3 as part of the auxiliary components. In a preferred embodiment, fuel system components 401 are disposed in the dead space K4. Since the dead spaces K3 and K4 between the engine 10 and the long intake pipes 36*a* are used effectively to dispose auxiliary components, the outboard motor 1 can remain compact.

With continued reference to the embodiment illustrated in FIGS. 2-6, fuel injection valves 40 for each cylinder are inserted into the portions of the cylinder heads 32 corresponding to the intake ports 32*e*. Each fuel injection valve 40 has an injection nozzle facing its corresponding combustion chamber 32*d*, and cylindrical fuel supply rails 41 extending along the crankshaft 10*a* are located outside the cylinder heads 32.

A fuel supply device 50 for supplying fuel to the fuel injection valves 40 is basically constituted as follows. A fuel filter 57, a low pressure primary pump 52 built-in a sealed container 58 for delivering the fuel, and a vapor separator 53 are mounted in the front part of the side wall on the engine 10.

In the fuel supply device 50, fuel in a fuel tank 55 mounted on the hull is supplied to the vapor separator 53 through a low-pressure fuel pipe 54*a*, the fuel filter 57, a low-pressure fuel pipe 54*b*, and a primary pump 52 by driving the low-pressure primary pump 52. Excessive fuel discharged from a delivery port 52*a* of the primary pump 52 is returned to the side of a suction port 52*c* of the primary pump 52 through a return passage 52*b*.

The fuel is supplied to a high-pressure secondary pump 42 through a fuel pipe 56 by driving the primary pump 52 incorporated in the vapor separator 53, and the fuel pressurized by the secondary pump 42 is supplied to the upper ends of the right and left fuel supply rails 41 through a high-pressure fuel pipe 43 and right and left branch hoses 44. Then, while the injection nozzles of the fuel injection valves 40 are opened, the fuel is injected into the combustion chambers 32*d*.

A canister 60 preferably is fixedly attached to the vapor separator 53. The canister 60 is made up of a case 60*a* directly connected to the vapor separator 53 and filled with an adsorptive activator 60*b* such as activated charcoal. The vapor in the vapor separator 53 flows into the canister 60, and fuel in the vapor is adsorbed therein. The air separated from fuel by adsorption is discharged into the cowling 3 through a discharge pipe 61. The canister 60 is located below the left intake manifold 36, and the vapor separator 53 and the canister 60 constituting the fuel system component 401 is disposed in the dead space K4 formed on the left side of the cylinder block 30 by the V-bank in a compact manner as shown in FIG. 2, FIG. 4 and FIG. 5.

The fuel filter 57 is located on the opposite side of the cylinder heads 32 with respect to the crankshaft 10*a* of the engine 10 in the cowling 3 consisting of the top cowling 3*a* and the bottom cowling 3*b*. The fuel filter 57 is attached to the hull side of the engine 10 in front of the surge tank 200.

The fuel filter 57 has a main body 57*a*, a cap 57*b* and a filter 57*c*, and the main body 57*a* is fixedly fastened to a bracket 59. The bracket 59 is secured to the hull side of the surge tank 200. The main body 57*a* has a recess with female threads and the cap 57*b* has a mounting portion with male threads so that the cap 57*b* can be removably attached to the main body 57*a* by a thread structure. The main body 57*a* has a supply port 57*a*2 and a discharge port 57*a*3, and the low-pressure fuel pipe 54*a* is connected to the supply port 57*a*2 and the low-pressure fuel pipe 54*b* is connected to the discharge port 57*a*3.

The fuel filter 57 is covered with at least a heat insulating material 70, and the heat insulating material 70 has a shape consistent with the shape of the fuel filter 57. The heat insulating material 70 consists of a plurality of portions: a portion 7*a* covering the main body 57*a* and a portion 70*b* covering the cap 57*b*, and the fuel filter 57 is covered with the plurality of portions. The heat insulating material 70 preferably is made of a foamed rubber. The portion 70*a* covering the main body 57*a* is shaped in advance into a shape consistent with the external shape of the main body 57*a*, and the portion 70*b* covering the cap 57*b* is shaped in advance into a shape consistent with the external shape of the cap 57*b*.

Since the fuel filter 57 is covered with at least the heat insulating material 70, the fuel filter 57 can be prevented from being heated by the engine 10 and the fuel therein can be prevented from being evaporated. Also, the heat insulating material 70 preferably has a shape consistent with the shape of the fuel filter 57. Since the heat insulating material 70 is consistent with the filter shape, a gap is unlikely to be formed between the fuel filter 57 and the heat insulating material 70. Therefore, heat-insulating efficiency can be improved. In addition, the heat insulating material 70 preferably consists of a plurality of portions, and the fuel filter 57 is covered with the plurality of portions. A portion 70*a* for the main body 57*a* and a portion 70*b* for the cap 57*b* can be easily attached to the main body 57*a* and the cap 57*b*, respectively. Also, when the cap 57*b* is removed from the main body 57*a* to clean the filter 57*c* or replace the filter 57*c* with new one, the heat insulating material 70 can be easily attached to the fuel filter 57. Therefore, the fuel filter 57 can be easily assembled, and the work for replacement or maintenance thereof can be improved.

Also, at the time of such work, since the fuel filter 57 is located in the hull side of the engine 10 in the cowling 3, the worker can easily remove the top cowling 3*a* from the bottom cowling 3*b* and attach the top cowling 3*a* to the bottom cowling 3*b* from the hull side. Therefore, the fuel filter 57 can be easily assembled, and the work for replacement or maintenance of the fuel filter 57 can be improved.

In addition, since the fuel filter 57 is located on the opposite side of the cylinder heads 32 with respect to the crankshaft 10*a* of the engine 10 in the cowling 3, the fuel filter 57 can be apart from the exhaust manifolds 34 extending from the cylinder heads 32 and prevented from being heated more reliably.

In the engine room 15, air X is introduced through the air intake port 3*a*1 and air Y within the cowling is heated by the engine 10. Such air X, Y flows to the intake opening 38*a* of the intake silencer 38. However, since the fuel filter 57 is located below the intake opening 38*a* of the engine 10 opening in the cowling 3, where it is not affected by the flow of the air Y, the fuel filter 57 can be prevented from being heated.

At least a part of the fuel pipe 54 connected to the fuel filter 57, more specifically the fuel pipes 54*a* and 54*b*, preferably are covered with heat insulating materials 71 and 72, respectively. The fuel pipe 54*a* extends through a front right part 3*b*11 of the bottom cowling 3*b* into an inner right part of the bottom cowling 3*b*, extends in a curve in the vicinity of and below the surge tank 200, is bent upward from a position below the fuel filter 57, and is connected to the supply port 57*a*2 from the left side of the fuel filter 57. The fuel pipe 54*b* is connected to the discharge port 57*a*3 on the right side of the fuel filter 57, extends downward from the right side of the fuel filter 57 along the fuel filter 57, extends leftward below the fuel filter 57, and is connected to the primary pump 52 housed in the sealed container 58.

As shown in FIG. 2 and FIG. 4, since the low-pressure fuel pipe 54*a* for supplying the fuel in the fuel tank 55 mounted on the hull and the low-pressure fuel pipe 54*b* from the fuel filter 57 to the primary pump 52 are installed around the fuel filter 57 using a dead space K2 below the surge tank 200, and since the low-pressure fuel pipe 54*a* for supplying the fuel in the fuel tank 55 mounted on the hull and the low-pressure fuel pipe 54*b* from the fuel filter 57 to the primary pump 52 are covered with the heat insulating materials 71 and 72, respectively, not only the fuel filter 57 but also at least some part of the fuel pipe 54 can prevent the fuel therein from being heated by engine operation. The section of the fuel pipe 54 up to the low-pressure primary pump 52 is covered with the heat insulating materials 71 and 72. Since a negative pressure is produced and the fuel tends to be evaporated in the fuel pipes 54*a* and 54*b* as well as in the fuel filter 57 when the low-pressure primary pump 52 is driven, the heat insulating materials 71 and 72 covering the fuel pipes 54*a* and 54*b* more reliably prevent the fuel therein from being heated.

The heat insulating materials 71 and 72, as well as the heat insulating material 70, preferably are made of a foamed rubber. Although water is likely to enter the cowling 3, even if water enters heat insulating properties and durability of these materials are not deteriorated. In addition, the heat insulating materials 70, 71 and 72 can be produced inexpensively and can be easily attached. Therefore, the heat insulating materials 70, 71 and 72 can be easily assembled, and the work for replacement or maintenance thereof can be improved.

Although the present disclosure has been in the context of an eight cylinder, V-type engine, it is to be understood that engines having other numbers of cylinders and other configurations can employ principles discussed herein. Also, other systems, such as the fuel delivery system, may differ from the description in the specifically-discussed embodiments.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An outboard motor adapted to be mounted on a hull of a watercraft, the outboard motor including an engine generally enclosed within a cowling and having a crankshaft arranged to extend generally vertically when an attached watercraft hull is in a cruising condition, the outboard motor further comprising a first surge tank disposed on a side of the crankshaft generally opposite a head portion of the engine, a plurality of long intake conduits having first and second ends and extending between an engine intake port and the surge tank, a second surge tank disposed between the plurality of long intake conduits and the engine, the second surge tank communicating with the first surge tank, a plurality of short intake conduits, each of the short intake conduits provided between the first and second ends of a corresponding one of the long intake conduits and communicating with the second surge tank, and valves for selectively opening and closing the short intake conduits.

2. The outboard motor according to claim 1, wherein the engine comprises a left and a right bank of cylinders arranged in a V-type configuration.

3. The outboard motor according to claim 2, wherein second surge tanks are provided on opposing sides of the engine, and wherein the second surge tanks communicate with one another.

4. The outboard motor according to claim 3, wherein spaces are defined on opposite sides of the engine between at least a portion of the long intake conduit and the engine, and an auxiliary component is disposed in each space.

5. The outboard motor according to claim 2, wherein a plurality of valves are arranged to have coaxial valve shafts, and an actuator for selectively opening and closing the valves is arranged coaxially with the valve shafts.

6. The outboard motor according to claim 5, wherein the actuator is disposed in a space defined between the engine and an outer surface of a long intake conduit.

7. The outboard motor according to claim 5, wherein second surge tanks are provided on opposing sides of the engine, and wherein the second surge tanks communicate with one another.

8. The outboard motor according to claim 5, wherein a space is defined between at least a portion of the long intake conduit and the engine, and an auxiliary component is disposed in the space.

9. The outboard motor according to claim 8, wherein the auxiliary component comprises a starter motor.

10. The outboard motor according to claim 1, wherein a space is defined between at least a portion of the long intake conduit and the engine, and an auxiliary component is disposed in the space.

11. The outboard motor according to claim 10, wherein the auxiliary component comprises a starter motor.

12. The outboard motor according to claim 1, wherein a plurality of valves are arranged to have coaxial valve shafts, and an actuator for selectively opening and closing the valves is arranged coaxially with the valve shafts.

13. The outboard motor according to claim 12, wherein the actuator is disposed in a space defined between the engine and an outer surface of a long intake conduit.

14. The outboard motor according to claim 13, wherein an auxiliary component is disposed in the space between the engine and the outer surface of the long intake conduit.

* * * * *

UNITED STATES PATENT AND TRADEMARK OFFICE

CERTIFICATE OF CORRECTION

PATENT NO. : 7,395,795 B2
APPLICATION NO. : 11/647632
DATED : July 8, 2008
INVENTOR(S) : Takayuki Osakabe and Yoshibumi Iwata It is certified that error appears in the above-identified patent and that said Letters Patent is hereby corrected as shown below:

At Column 4, Line 32, please delete "31 a" and insert --31a--, therefor.

At Column 5, Line 26 (Approx.), please delete "low-and" and insert --low- and--, therefor.

At Column 5, Line 63, please delete "dimension" and insert --dimensions--, therefor.

At Column 6, Line 1, please delete "FIG. 5." and insert --FIG. 5,--, therefor.

At Column 7, Line 5, please delete "7a" and insert --70a--, therefor.

Signed and Sealed this

Thirtieth Day of March, 2010

David J. Kappos

David J. Kappos
*Director of the United States Patent and Trademark Office*